United States Patent [19]

Liebergott et al.

[11] Patent Number: 4,804,440

[45] Date of Patent: Feb. 14, 1989

[54] MULTISTAGE BRIGHTENING OF HIGH YIELD AND ULTRA HIGH-YIELD WOOD PULPS

[75] Inventors: Norman Liebergott, Laval; Cyril Heitner, Pierrefonds, both of Canada

[73] Assignee: Pulp and Paper Research Institute of Canada, Pointe Claire, Canada

[21] Appl. No.: 168,219

[22] Filed: Mar. 15, 1988

Related U.S. Application Data

[63] Continuation of Ser. No. 804,200, Dec. 3, 1985.

[30] Foreign Application Priority Data

Dec. 21, 1984 [CA] Canada ..... 470961

[51] Int. Cl.[4] ..... D21C 9/10; D21C 9/16

[52] U.S. Cl. ..... 162/70; 162/71; 162/72; 162/78; 162/80; 162/83; 162/84

[58] Field of Search ..... 162/26, 78, 80, 84, 162/56, 60, 24, 83, 72, 71, 70

[56] References Cited

U.S. PATENT DOCUMENTS

| | | | |
|---|---|---|---|
| 2,290,601 | 7/1942 | Reichert | 162/78 |
| 2,435,566 | 2/1948 | Adams et al. | 162/78 |
| 2,862,784 | 12/1958 | Kise | 162/78 |
| 2,865,701 | 12/1958 | Shroeder | 162/78 |
| 3,100,732 | 8/1963 | Smedberg | 162/78 |
| 4,294,653 | 10/1981 | Lindahl et al. | 162/78 |
| 4,619,733 | 10/1986 | Kooi | 162/78 |

FOREIGN PATENT DOCUMENTS

| | | | |
|---|---|---|---|
| 3333219 | 3/1984 | Fed. Rep. of Germany | 162/78 |

*Primary Examiner*—Steve Alvo

*Attorney, Agent, or Firm*—Lawrence I. Field

[57] ABSTRACT

A multistage process for bleaching high-yield and ultra high-yield pulps is described whereby the pulp is treated sequentially with a peroxygen compound, a reducing compound and a final peroxygen compound to achieve higher brightness levels.

8 Claims, No Drawings

MULTISTAGE BRIGHTENING OF HIGH YIELD AND ULTRA HIGH-YIELD WOOD PULPS

This application is a continuation of U.S. patent application Ser. No. 804,200 filed Dec. 3, 1985.

This invention relates to a method for the brightening of high-yield and ultra high-yield pulps and, more particularly, to a process of super-brightening such pulps with a sequential bleaching process.

Various processes are employed in the pulp and paper industry to bleach high-yield and ultra high-yield pulps. Peroxide is the most commonly employed one stage oxidizing agent for bleaching mechanical pulps. This alkaline process is normally carried out at high pulp consistency, i.e. 15–25%; moderate temperatures —i.e. 60° C.; and retention times of 2 to 3 hours. In peroxide bleaching, it is also known to use stabilizers such as sodium silicate and magnesium sulphate in the bleach liquor. This addition prevents decomposition of the oxidizing agent. Furthermore, mechanical pulps are normally pretreated at a low consistency with organic chelating agents, such as sodium diethylenetriamine penta-acetate (DTPA), to remove naturally occurring trace metals. ISO brightnesses of 73–75% are conventionally achieved using this one stage process.

Another one step brightening process for mechanical pulps utilizes sodium hydrosulphite, a reducing agent, as the brightening agent. This process is usually carried out in an aqueous phase at 3 to 4% consistency, a pH of 4.5 to 6, a temperature of about 60° C. and a retention time of one hour. The use of a chelating or sequestering agent such as sodium tripolyphosphate (STPP) is recommended, the agent being added to the pulp prior to the addition of the reducing agent. This method of bleaching usually increases the brightness of mechanical pulps 7–9 ISO-brightness points to a level of 70%.

Two stage bleaching of groundwood pulp using peroxide in the first stage and hydrosulphite (dithionite) in the second stage is well known and applied commercially. An ISO-brightness level of 76% has been achieved. However, much lower brightness levels are achieved when this two stage sequence is reversed (Schroter, H., Wbl. Papriefabr. 97, No. 23/24 (1969) p. 1023 and Joyce, P. and Mackie, M., CPPA, TAPPI International Pulp Bleaching Conference, Toronto, Canada, June 11–14, 1979, Preprint Page 116). Loras, V. and Soteland, N. disclose a three stage bleach sequence utilizing in sequence, borohydride, peroxide and dithionite. This sequence was reported to yield a brightness of 88% from an initial level of 67%, an increase of 21 brightness points. (High Brightness Bleaching of Mechanical Pulp, Norsk Skogindustri, 10/72 p. 255). It is also known from U.S. Pat. No. 3,100,732 to Smedberg to use a combined and simultaneous action of an oxidizing agent and a reducing agent; the patentee also discloses that if used in sequence, one uses the oxidizing agent followed by the reducing agent.

It is an object of the present invention to provide a multistage bleaching process for high-yield and ultra high-yield pulps which gives high brightness levels to such pulps.

According to the present invention, there is provided a method for the bleaching of high-yield or ultra high-yield pulp which comprises the steps of seqentially treating the wood pulp with a peroxygen compound, a reducing compound and a second peroxygen compound.

In greater detail, the method or process includes at least three stages wherein the wood pulp is subjected to bleaching operations. The wood pulp which may be utilized is any high-yield or ultra high-yield pulp such as mechanical, chemimechanical, chemithermomechanical, groundwood and high-yield sulphite pulps.

In the first stage, the pulp is bleached with a peroxygen compound. Preferred conditions of bleaching include:

(1) a peroxygen compound charge of about 0.5 to about 3% by weight of oven dried pulp in the presence of sodium hydroxide, sodium silicate and magnesium sulphate;

(2) a reaction temperature of between about 60° C. to about 100° C.;

(3) a reaction time of from about 4 minutes to about 120 minutes;

(4) a pulp consistency of from about 6% to about 25%; and (5) a reaction terminating pH of from about 7.5 to about 9.5.

Subsequent to the first bleaching step, one may utilize an optional washing step. This washing step is not necessary; if the washing step or treatment is utilized, a compound such as $SO_2$ which contains $SO_3^{50}$ ions in aqueous solution may be utilized to bring the pH into a range of from about 5 to 6. Instead of washing, the pulp may be pressed after the bleaching steps.

In the second stage, the wood pulp is treated with a reducing compound which may be chosen from many such reducing compounds known to those skilled in the art. During this second stage, preferred reaction conditions include:

(1) a reducing compound charge of about 0.1 to about 3.0% by weight of oven dried pulp;

(2) the presence of a chelating agent such as DTPA or STPP;

(3) a reaction temperature of from about 60° C. to about 100° C.;

(4) a reaction time of from about 4 to about 120 minutes;

(5) a pulp consistency of from about 3% to about 25%, and (6) a reaction terminating pH of about 3.5 to about 10.5.

After the above reduction step, a washing or pressing step as is known in the art is subsequently carried out.

The third and final bleaching stage utilizes a peroxygen compound as in the first stage. The preferred reaction conditions include:

(1) a peroxygen compound charge of about 0.01% to about 2.0% in the presence of sodium hydroxide, sodium silicate and magnesium sulphate;

(2) a reaction temperature of from about 60° C. to about 100° C.;

(3) a reaction time of about 4 minutes to about 240 minutes;

(4) a pulp consistency of from about 6% to about 25%; and (5) a reaction terminating pH from about 7.5 to about 9.5.

The compounds utilized in the process of the present invention may be selected from among those well known to those skilled in the art. Thus, the peroxygen compound utilized in the first and third stages may include conventional inorganic peroxides such as hydrogen peroxide and sodium peroxide and also organic peroxides such as peroxide, ditertiarybutyl peroxide and peracetic acid. Examples of reducing compounds which may be chosen from commercially inorganic reducing agents such as sodium or zinc hydrosulphite sodium or magnesium bisulphite, sodium borohydride, a proprietary aqueous solution containing about 12% wt of sodium borohydride and approximately 40% wt of sodium hydroxide, sold under the trademark "BOROL", thiourea dioxide, ammonium borohydride, hydrazine and organic reducing agents such as amine-boranes and phosphineboranes It will be noted that some of these reducing agents are sold commercially with a chelating agent mixed therewith. However, when a chelating agent has already been introduced with the pulp prior to the first stage peroxide treatment, as is a common practice, no further addition of a chelating compound is required.

The most preferred charge of the peroxygen compound in the first stage is 1–2.5% by weight of oven-dried pulp. Sodium hydroxide, sodium silicate and magnesium sulphate are preferably added in charge ranges of 0.25–2%, 0.0 to 2.5% and 0.01–0.05%, respectively, in order to stabilize the peroxygen compound, in the form of the perhydroxyl ion and to initiate and maintain a stable bleaching reaction. Although it is common practice in a one-stage bleaching process to leave about 15 to 20% of the initial charge of peroxygen compound as a residual to prevent alkali darkening of the pulp, because of a shorter reaction time, it is preferred to lower this residual level to 1 to 10% in order to conserve $SO_3^{50}$ and allow a lower initial charge of oxidant addition. In contrast to present practice, a temperature range of 75° to 90° C. and a 10 to 20 minute reaction time is preferred for optimized bleaching efficiency in the first stage. The higher temperature together with efficient mixing allows the use of a short reaction time while achieving maximum brightness levels. Also, with proper attention to efficient mixing, a pulp consistency of about 10% was found to be as effective as a 30% pulp consistency for brightness improvement.

In the second stage, it has been found that the maximum brightness level is achieved utilizing a charge of about 0.3% to about 3.0% by weight of the reducing agent based on oven-dried pulp. With efficient mixing, for maximum brightness, the most preferred temperature range is between 65° C. to 85° C.; a consistency of between 4% and 15%; and a reaction time of between 1 to 20 minutes.

In the third stage, wherein the wood pulp is treated with a second peroxygen compound, the preferred charge of oxidant is between 0.3% to 2.0% by weight based on O.D. wood. The charges of sodium hydroxide, sodium silicate and magnesium sulphate, by weight are between 0.1 to 1.0%, 0.0–2.0% and 0.01–0.05% by weight respectively. The most preferred ranges of temperature, time and pulp consistency are respectively 75° C.–95° C., 10–60 minutes and 9%–20%. After the bleaching, the pulp is subject to a pressing and/or washing step or treated with a compound such as sulphur dioxide which contains $SO_3^{50}$ ions in aqueous solution to bring the pH to about 6. However, if there is residual peroxygen remaining after the final reaction it can be separated from the pulp, i.e. by pressing and the pressate recirculated to the first and/or third stages as part of the make-up solution.

As an optional step, and prior to the first stage wherein the pulp is bleached with a peroxygen compound, the pulp may be subjected to a pretreatment step with a reducing compound. In this pretreatment step, one may utilize a charge of between about 0.1% to 3.0% by weight of the reducing agent based on oven dried pulp. A preferred temperature range is between 40° C. and 100° C.; a consistency of between 3% and 25% is preferred with a preferred reaction time of between 1 and 60 minutes; and at reaction terminating pH of between 7 and 12. The pretreated pulp may then be pressed to the desired consistency for the first stage. The compounds employed may be selected from those previously discussed.

Having thus generally described the invention, reference will be made to the following examples.

EXAMPLE I 100 g of commercial spruce balsam chemithermomechanical pulp, brightness 56.1% ISO taken from a disc filter of a mill was treated with a solution containing 2.0% hydrogen peroxide on O.D. pulp, 2.5% sodium silicate, 1.0% sodium hydroxide, 0.05% magnesium sulphate with sufficient water to reduce the pulp consistency to 10%. The temperature of this treatment was 85° C. and the reaction time was 10 minutes. At the end of the reaction the pH was 8.5. The residual peroxide concentration was tested and found to be 0.4% $H_2O_2$ on O.D. pulp. The brightness of a washed sample after this stage was 70% ISO. A portion of the peroxide treated pulp was treated with $SO_2$ bringing the pH to 6 and a solution containing 0.8% sodium hydrosulphite on O.D. pulp and 0.2% chelating agent STPP was added to the pulp with enough water to bring the consistency to 10%. The temperature of the reaction was 75° C. and the reaction time was 15 minutes. At the end of the reaction the pH of the pulp and the bleaching solution was 5.1. The pulp was carefully washed by bringing the pulp down from 10% consistency to 1% and then raised to 14%. The brightness of the pulp at the completion of the stage was 79.6% ISO.

To complete the three stage process, the peroxide/-hydrosulphite pulp was treated with a solution containing 2.0% hydrogen peroxide on O.D. pulp, 2.5% sodium silicate, 1.0% sodium hydroxide and 0.05% magnesium sulphate with sufficient water to reduce the pulp consistency to 10%. The reaction temperature was 85° C. and the reaction time was 10 minutes. The pH at the end of the reaction was 8.2 and the pulp after souring and washing had a brightness of 84.2%. The peroxide residual measured at the end of the reaction was 1.6% $H_2O_2$ on O.D. pulp. In subsequent experiments, this residual was separated from the pulp by pressing and the pressate was recirculated to the first and/or third bleaching stages. No detrimental effect on the final bleaching properties of the pulp was observed.

EXAMPLE II

A comparative test using conventional conditions for each stage of a three stage bleaching sequence was conducted on another sample of the same unbleached pulp used in Example I. 100 g of the pulp was treated with a solution containing 2% hydrogen peroxide, 2.5% sodium hydroxide, 2.5% sodium silicate, 0.05% magnesium sulphate and sufficient water to reduce the pulp consistency to 10%. The pulp was then placed into a bath and the temperature maintained at 60° C. for 2 hours. A sample of pulp tested for brightness after souring with $SO_2$ and washing showed the pulp had reached a brightness of 70% ISO. The residual peroxide concentration measured at this point was equivalent to 0.3%

$H_2O_2$ on pulp O.D. basis. A portion of the peroxide treated pulp was soured with $SO_2$ to pH 6 and then treated with a 0.8% solution of sodium hydrosulphite including 1.5% of STPP and enough water to bring the consistency to 5%. The reaction temperature was 60° C. and the retention time was 1 hour. A portion of the pulp was washed and the brightness measured on this sample was 74.5% ISO.

The washed peroxide/hydrosulphite pulp was then treated in a second peroxide oxidation stage using a 2.0% solution containing hydrogen peroxide on 0.D. pulp, 2.5% sodium silicate, 2.5% sodium hydroxide, 0.05% magnesium sulphate and sufficient water to reduce the pulp consistency to 15%. The temperature of the pulp was maintained at 60° C. for 2 hours. The final pH at the end of this period was 9.5. The pulp was then soured with $SO_2$ to pH 6 and washed. The final brightness of the peroxide hydrosulphite peroxide pulp was 79.4% ISO. The residual peroxide concentration was measured to be 1.1% $H_2O_2$ on O.D. pulp.

EXAMPLE III 100 g of commercial spruce balsam thermomechanical pulp, brightness 59.7% ISO was treated with a solution containing 2% hydrogen peroxide on O.D. pulp, 2.0% sodium silicate, 1.8% sodium hydroxide, 0.05% magnesium sulphate, and enough water to reduce the pulp consistency to 25%. The temperature of this treatment was 83° C. Treatment time was 25 minutes. The residual hydrogen peroxide charge was tested and found to be 0.6% cn O.D. pulp. The brightness after this stage was 71.2% ISO. The peroxide treated pulp was treated with sodium bisulphite bring the pH to 6. The excess sodium bisulphite was washed out with water and a solution containing 0.5% sodium borohydride and 0.6% sodium hydroxide was added to the pulp along with enough water to bring the consistency to 15%. The temperature of this treatment was 60° C. and the treatment time was 30 minutes. The brightness of the pulp at this stage was 72.4% ISO.

A portion of the peroxide/borohydride treated pulp was pressed to consistency greater than 25% and treated with a 2.0 solution of hydrogen-peroxide, 2.0% sodium silicate (as 41° Be solution) on O.D. pulp, 2.0% sodium hydroxide, and 0.05% magnesium sulphate, and sufficient water to reduce the consistency to 25%. This third stage treatment was conducted at a temperature of 80° C. for a time of 40 minutes. The hydrogen peroxide residual was 0.64% charge on O.D. pulp. After washing with a sodium bisulphite solution, the pulp brightness achieved was 80.5% ISO.

EXAMPLE IV 100 g of a commercial western spruce-loblolly pine chemithermomechanical pulp, brightness 56.8% ISO taken from the latency chest of a mill was treated with a solution containing 2.0% hydrogen peroxide on O.D. pulp, 2.5%, sodium silicate, 2.0% sodium hydroxide, 0.05% magnesium sulphate with sufficient water to reduce the pulp consistency to 10%. The temperature of this treatment was 90° C. and the reaction time was 10 minutes. At the end of the reaction the pH was 8.9. The residual peroxide concentration was tested and found to be 0.3% $H_2O_2$ on O.D. pulp. The brightness of a washed sample after this stage was 72% ISO. A portion of the peroxide treated pulp was treated with $SO_2$ bringing the pH to 6 and a solution containing 0.8% sodium hydrosulphite on O.D. pulp and 0.2% chelating agent STPP was added to the pulp with enough water to bring the consistency to 10%. The temperature of the reaction was 85° C. and the reaction time was 11 minutes. At the end of the reaction the pH of the pulp and the bleaching solution was 5.6. The pulp was carefully washed by bringing the pulp down from 10% consistency to 1% and then raised to 14%. The brighness of the pulp at the completion of the stage was 77.3% ISO.

To compete the three stage process, the peroxide/hydrosulphite pulp was treated with a solution containing 2.0% hydrogen peroxide on O.D. pulp, 2.5% sodium silicate, 2.0% sodium hydroxide and 0.05% magnesium sulphate with sufficient water to reduce the pulp consistency to 10%. The reaction temperature was 90° C. and the reaction time was 10 minutes. The pH at the end of the reaction was 8.8 and the pulp after souring and washing had a brightness of 83.6%. The peroxide residual measured at the end of the reaction was 1.8% $H_2O_2$ on O.D. pulp.

EXAMPLE V 100 g of a commercial spruce-balsam high yield sulphite pulp, brightness 58.2% ISO taken from the high density storage of a mill was treated with a solution containing 2.0% hydrogen peroxide on O.D. pulp, 2.5%, sodium silicate, 2.0% sodium hydroxide, 0.05% magnesium sulphate with sufficient water to reduce the pulp consistency to 10%. The temperature of this treatment was 85° C. and the reaction time was 10 minutes. At the end of the reaction the pH was 8.9. The residual peroxide concentration was tested and found to be 0.1% $H_2O_2$ on O.D. pulp. The brightness of a washed sample after this stage was 68.7% ISO. A portion of the peroxide treated pulp was treated with $SO_2$ bringing the pH to 6 and a solution containing 0.8% sodium hydrosulphite on O.D. pulp and 0.2% chelating agent STPP was added to the pulp with enough water to bring the consistency to 10%. The temperature of the reaction was 80° C. and the reaction time was 15 minutes. At the end of the reaction the pH of the pulp and the bleaching solution was 5.0. The pulp was carefully washed by bringing the pulp down from 10% consistency to 1% and then raised to 14%. The brightness of the pulp at the completion of the stage was 72.6% ISO.

To complete the three stage process, the peroxide/-hydrosulphite pulp was treated with a solution containing 2.0% hydrogen peroxide on O.D. pulp, 2.5% sodium silicate, 2.0% sodium hydroxide and 0.05% magnesium sulphate with sufficient water to reduce the pulp consistency to 10%. The reaction temperature was 90° C. and the reaction time was 20 minutes. The pH at the end of the reaction was 9.1 and the pulp after souring and washing had a brightness of 81.3%. The peroxide residual measured at the end of the reaction was 1.3% $H_2O_2$ on O.D. pulp.

EXAMPLE VI 100 g of commercial spruce-balsam chemithermomechanical pulp, brightness 53.7% ISO taken from the second stage refiner at 24% pulp consistency was diluted with enough mill white water containing 0.2% DTPA on O.D. pulp, to reduce the consistency of the pulp to 4%. The pulp was then drained to 15% consistency. The pulp was treated with a solution containing 2% hydrogen on O.D. pulp, 1.75% sodium hydroxide, 2.5% sodium silicate, 0.05% magnesium sulphate and sufficient water to reduce the pulp consistency to 10%. The temperature of this treatment was 85° C. and the reaction time was 30 minutes. At the end of this reaction the pH was 8.7. The pulp stock was pressed to 27% consistency. The residual peroxide concentration was determined and found to be 0.97% $H_2O_2$ on O.D. pulp.

The brightness of a sample taken from the pressed stock after this stage was 70.3% ISO. The remaining pressed peroxide treated stock was treated with a solution containing 0.3% BOROL on O.D. pulp (equivalent to 0.043% sodium borohydride on O.D. pulp) with sufficient water to reduce the pulp consistency to 10%. The temperature of this treatment was 65° C. and the reaction time was 10 minutes. At the end of reaction the pH was 10.1. The pulp stock was pressed to 27% consistency. The brightness of a sample taken from the peroxide/BOROL treated pulp was 71.7% ISO.

To complete the three-stage process, one-half of the peroxide/BOROL treated pulp was further treated with a solution containing 2% hydrogen peroxide on O.D. pulp, 2.0% sodium hydroxide, 2.5% sodium silicate, 0.05% magnesium sulphate with sufficient water to reduce the pulp consistency to 10%. The reaction temperature was 86° C. and the time was 120 minutes. The pH at the end of the reaction was 9.9 and the pulp after washing had a brightness of 81.7% ISO. The peroxide residual measured at the end of the reaction was 1.1%. In subsequent experiments, this residual was separated from the pulp by pressing and the pressate was recirculated to the first and/or third bleaching stage.

To the other half of the peroxide/BOROL treated pulp, a solution containing 2.0% hydrogen peroxide on O.D. pulp, 2% sodium hydroxide, 2.5% sodium silicate and 0.05% magnesium sulphate with sufficient water to reduce the pulp consistency to 20%. The reaction temperature was 83° C. and the retention time 120 minutes. The reaction temperature was 83° C. and the retention time 120 minutes. The pH at the end of the reaction was 10.2 and the pulp after washing had a brightness of 82.5% ISO. The peroxide residual at the end of the reaction was 0.62% on pulp O.D. basis.

As will be seen from the above, the novel process of the present invention provides pulp with a high brightness. Example II, which used the same sequence as Example I, but conventional conditions as taught by the art, did not achieve the same brightness.

EXAMPLE VII 100 g of commercial spruce-balsam chemithermomechanical pulp, brightness 53.7% ISO taken from the second stage refiner at 24% pulp consistency was treated with a solution containing 0.3% BOROL on O.D. pulp (equivalent to 0.043% sodium borohydride on pulp) and 0.2% DTPA on pulp with sufficient water to reduce the consistency to 10%. The temperature of this pretreatment was 70° C. and the time was 15 minutes. At the end of the reaction, the pH was 9.5. The pulp stock was pressed to 15% consistency.

The pulp was then treated with a solution containing 2.0% hydrogen peroxide on O.D. pulp, 1.75% sodium hydroxide, 2.5% sodium silicate, 0.05% magnesium sulphate and sufficient water to reduce the pulp consistency to 10%. The temperature of this treatment was 84° C. and the reaction time was 30 minutes. At the end of this reaction, the pH was 9.5. The pulp stock was pressed to 27% consistency. The residual peroxide concentration was found to be 1.04%. The brightness of a sample taken from the pressed stock, after this stage, was 71.4% ISO. The remaining pressed BOROL/-peroxide treated stock was treated with a solution containing 0.3% BOROL (aqueous solution of sodium borohydride and sodium hydroxide) on O.D. pulp (equivalent to 0.043% sodium borohydride on O.D. pulp) with sufficient water to reduce the consistency to 10%. The temperature of this treatment was 65° C. and the reaction time, 10 minutes. At the end of the reaction, the pH was 10.3. The brightness of a sample taken from the BOROL/peroxide/BOROL treated pulp was 72.6% ISO.

To complete the four-stage process, the BOROL/-peroxide/BOROL treated pulp was further treated with a solution containing 2% hydrogen peroxide on O.D. pulp, 2.0% sodium hydroxide, 2.5% sodium silicate, 0.05% magnesium sulphate with sufficient water to reduce the pulp to 10%. The reaction temperature was 80° C. and the time was 120 minutes. The pH at the end of the reaction was 10.3 and the pulp after washing had a brightness of 81.6% ISO. The peroxide residual measured at the end of the reaction was 1.13%.

EXAMPLE VIII

Spruce chemithermomechanical pulp, taken from the second stage refiner at 20 percent consistency was diluted to 1 percent consistency, and DTPA at a charge of 0.15 percent on oven-dried O.D. pulp was added. The pulp slurry was stirred at 60° C. for 1 hour and then filtered to 20% consistency. The ISO brightness after this washing stage was 60.1%.

The pulp was then pretreated with BOROL (sodium borohydride and sodium hydroxide) solution at a charge of 0.275% on O.D. pulp and DTPA at a charge of 0.15% with sufficient water to decrease the consistency to 15%. The temperature of the treatment was 80° C. and the time was 15 minutes. At the end of the pretreatment the pH was 8.4.

The pulp stock was pressed to 30% consistency and treated with a charge of 2% hydrogen peroxide, 2.5% sodium hydroxide, 2.2% sodium silicate and 0.05% magnesium sulphate. All charges are based on dry weight of pulp. Sufficient water was used to bring the consistency to 25%. The temperature of hydrogen peroxide treatment (P1 stage) was 80° C. and the time of treatment was 90 minutes. At the end of this treatment the pH was 9.8 and the hydrogen peroxide residual was 0.18% on O.D. pulp. The ISO brightness was 75.3%.

The pulp was treated with a BOROL (an aqueous solution of sodium borohydride and sodium hydroxide) in a reduction stage at a charge of 0.275% and DTPA at a charge of 0.15% on O.D. pulp with sufficient water to decrease the consistency to 15%. The temperature of the treatment was 80° C. and the time was 15 minutes. At the end of the BOROL* treatment (R stage) the pH was 10.0.

After the BOROL (an aqueous solution of sodium borohydride and soidum hydroxide) treatment, the pulp was washed by diluting to 1% consistency and then dewatering to 30% consistency by filtration and pressing.

The process was completed by treating the BOROL/peroxide/BOROL pulp with 2% hydrogen peroxide on O.D. pulp, 1.5% sodium hydroxide, 2.2% sodium silicate, and 0.05% magnesium sulphate with enough water to bring the consistency to 25%. The treatment temperature was 80° C. and the time was 240 minutes. The pH at the end of the third stage was 10.0 and the residual hydrogen peroxide was 0.65% on O.D. pulp. After washing, the pulp had an ISO brightness of 81.4%.

It will be understood that the above-described embodiments are for purposes of illustration only and that changes and modifications may be made thereto without departing from the spirit and scope of the invention.

We claim:

1. A process suitable for bleaching high-yield and ultra-high yield pulps comprising the steps of:

(a) treating the pulp with a peroxygen compound at a charge of between 0.5 to 3% by weight based on oven-dried pulp at a temperature of between 60° C. to 100° C. for a period of from 4 minutes to 120 minutes at a pulp consistency of between 6% and 25% and a reaction terminating pH of from 7.5 to 9.5;

(b) then pressing the peroxygen treated pulp to produce a pulp of desired consistency and expressed liquid pressate or washing the peroxygen treated pulp to produce a washed pulp;

(c) treating the pressed or washed pulp with a reducing agent selected from the group of sodium bisulphite, magnesium bisulphite, sodium borohydride, thiourea dioxide, ammonium borohydride, hydrazine, and mixtures of sodium hydroxide and sodium borohydride at a charge of about 0.1 to about 3.0% by weight in the presence of a chelating agent at a reaction temperature of between 60° C. to 100° C. for a time of between 4 to 120 minutes at a pulp consistency of from 3% to 25% and a reaction terminating pH of between 3.5 to 10.5;

(d) then pressing or washing said reduced pulp to a desired consistency;

(e) then treating said pressed or washed pulp from (d) with a peroxygen compound at a charge of between 0.01% to 2.0% by weight at a temperature of between 60° C. to 100° C. for a time period of between 4 minutes to 240 minutes at a pulp consistency of between 6% to 25% and a reaction terminating pH of between 7.5 to 9.5; and (f) further pressing or washing the pulp resulting from treating step (e).

2. The process of claim 1 wherein the treatment of the pulp from step (e) is followed by a treating step with sulphur dioxide to a pH of about 6.

3. The process of claim 1 wherein the treatment with a peroxygen compound is done in the presence of sodium hydroxide, sodium silicate and magnesium sulphate.

4. The process of claim 1 wherein the peroxygen is selected from the group consisting of hydrogen peroxide, sodium peroxide, benzoyl peroxide, ditertiarybutyl peroxide and peracetic acid.

5. The process of claim 1 wherein the pulp is selected from the group of pulps consisting of mechanical, chemimechanical, chemithermomechanical, groundwood and high-yield sulphite pulps.

6. The process of claim 1 further including the step of pretreating the pulp, prior to step (a) with a reducing agent at a charge of between 0.1 to 3.0% by weight at a reaction temperature of between 40° C. and 100° C. for a time of between 1 and 60 minutes at a pulp consistency of from 3 to 25% with a reaction termination pH of between 7 and 12 and pressing the pretreated pulp.

7. The process of claim 1 where at least some of the liquid pressed from said pulp in pressing steps (b) and (f) is recycled to treat the pulp in at least one of steps (a) and (e).

8. A process suitable for bleaching high-yield and ultra-high yield pulps comprising the steps of:

(a) treating the pulp with a peroxygen compound at a charge of between 0.5 to 3% by weight based on oven-dried pulp at a temperature of between 60° C. to 100° C. for a period of from 4 minutes to 120 minutes at a pulp consistency of between 6% and 25% and a reaction terminating pH of from 7.5 to 9.5;

(b) then pressing the peroxygen treated pulp to produce a pulp of desired consistency and expressed liquid pressate or washing the peroxygen treated pulp to produce a washed pulp;

(c) treating the pressed or washed pulp with sodium hydrosulfite at a charge of about 0.1 to about 3.0% by weight in the presence of a chelating agent at a reaction temperature of between 60° C. to 100° C. for a time of between 4 to 120 minutes at a pulp consistency of from 3% to 25% and a reaction terminating pH of between 3.5 to 10.5;

(d) then washing said reduced pulp;

(e) then treating said washed pulp from step (d) with a peroxygen compound at a charge of between 0.01% to 2.0% by weight at a temperature of between 60° C. to 100° C. for a time period of between 4 minutes to 240 minutes at a pulp consistency of between 6% to 25% and a reaction terminating pH of between 7.5 to 9.5; and (f) further pressing or washing the pulp resulting from treating step (e).

* * * * *